US005709563A

United States Patent [19]

Saito

[11] Patent Number: 5,709,563

[45] Date of Patent: Jan. 20, 1998

[54] WATERPROOFING CONNECTOR

[75] Inventor: Hitoshi Saito, Shizuoka, Japan

[73] Assignee: Yazaki Corporation, Tokyo, Japan

[21] Appl. No.: 726,938

[22] Filed: Oct. 7, 1996

[30] Foreign Application Priority Data

Oct. 9, 1995 [JP] Japan ..... 7-261310

[51] Int. Cl.[6] ..... H01R 13/52

[52] U.S. Cl. ..... 439/275; 439/587

[58] Field of Search ..... 439/275, 587, 439/273, 274, 279, 589, 598, 271

[56] References Cited

U.S. PATENT DOCUMENTS 4,690,478 9/1987 Rahrig et al. ..... 439/587

*Primary Examiner*—Gary F. Paumen

*Assistant Examiner*—Tho D. Ta

*Attorney, Agent, or Firm*—Armstrong, Westerman, Hattori, McLeland & Naughton

[57] ABSTRACT

A waterproofing connector in which a wired terminal is inserted through a sealing member and a sealing cover into a plurality of terminal accommodating chambers provided in the connector housing thereof, whereas the terminals are sealed off through the sealing member by applying the sealing cover to the connector housing, wherein the sealing cover is formed with a plurality of aligned through holes and also with interconnections being formed by notches in partition walls between the respective adjacent through holes, the notches having a width narrower than the diameter of the through holes.

3 Claims, 3 Drawing Sheets

WATERPROOFING CONNECTOR

BACKGROUND OF THE INVENTION

1. Field of the Invention

The present invention relates to a waterproofing connector for use in an electrical distribution system within an automobile, including an improved sealing cover which is provided with a plurality of terminals, and capable of holding a sealing member.

2. Description of the Prior Art

Conventionally, there have been provided many waterproofing connectors so far, a case in point being the connector K as shown in FIG. 3, having a monolithic rubber plug c, wherein each of a member of thin cylindrical connector terminals T are respectively accommodated in the corresponding one of a plurality of terminal accommodating chambers b can be completely sealed off by putting a sealing cover d onto a housing a by way of the monolithic rubber plug c.

The monolithic rubber plug c is formed with a plurality of terminal insertion holes e, each aligning with the respective terminal accommodating chambers b. The sealing cover d is, as shown in FIG. 4, formed with a plurality of parallely aligned through holes f for inserting terminals therethrough respectively having partition walls g between the adjacent holes, and the outer opening of each of the through holes f is formed with a tapered surface h having a funnel shape respectively.

On the external wall of the sealing cover d, there is provided a resilient locking arm i, so that by fitting it with a locking claw j provided on the housing a, not only the monolithic rubber plug c is pressed, but the sealing cover d is secured to the housing a.

The connector terminal T is inserted by first pushing it through the through hole f of the sealing cover d manually or by an automatic inserting machine and thereafter, by further pushing it forward expanding the terminal insertion hole e of the monolithic rubber plug c until the terminal T is inserted into the terminal accommodating chamber b.

Since the through hole f is formed with a tapered surface h of a funnel shape, it is so arranged that the front end portion of the terminal T is guided by the tapered surface h to be inserted into the through hole f. However, in the event that the terminal T is not properly pressed against the tapered surface h, it is not guided into the through hole f, so that the terminal T is likely to get damaged, and the position thereof will have to be corrected.

Referring now to FIG. 5 to explain in more detail, within the area at which the tapered surface h is open to the external surface of the sealing cover d, the center position of the adjacent through holes f becomes a bias-limiting position P where the terminal T cannot be inserted any further. Likewise, in the event that the tip end of the terminal T' is excessively biased to one side, and gets over the bias-limiting position P, the tip end of the terminal T' comes off the tapered surface h, so that it is not properly guided into the through hole f and thus the terminal cannot be inserted or gets damaged.

Particularly in the case of a small-size connector or a multi-terminal connector in which the diameter of the terminal T is rather small, the distance between the two adjacent through holes f is thus required to be small, and consequently the tapered surface h should also be made small, whereby the bias-limiting position P is made narrow, and therefore, when the position of the terminal T is even slightly biased toward one side, it slips out of the tapered surface to make its insertion impossible, thereby causing such a problem that the productivity of the terminal insertion process is greatly reduced.

The present invention is made for solving the above problem, and it is an object of the present invention to provide a waterproofing connector in which connector terminals can be readily inserted, and thereby raising the productivity of the terminal inserting process.

SUMMARY OF THE INVENTION

In order to accomplish the above object, the present invention provides a waterproofing connector in which a wired terminal is inserted through a sealing member and a sealing cover into a plurality of terminal accommodating chambers provided in the connector housing thereof, whereas the terminal is sealed off through the sealing member by applying the sealing cover to the connector housing, wherein the sealing cover is formed with a plurality of aligned through holes for inserting terminals therethrough and also with interconnections being formed by notching partition walls provided between the respective adjacent through holes and having a width narrower than the diameter of the through holes.

Other features and advantages of the invention will be apparent from the following description taken in connection with the accompanying drawing.

DETAILED DESCRIPTION OF THE PREFERRED EMBODIMENTS

In the following, one embodiment of the present invention is explained.

Figure 1:
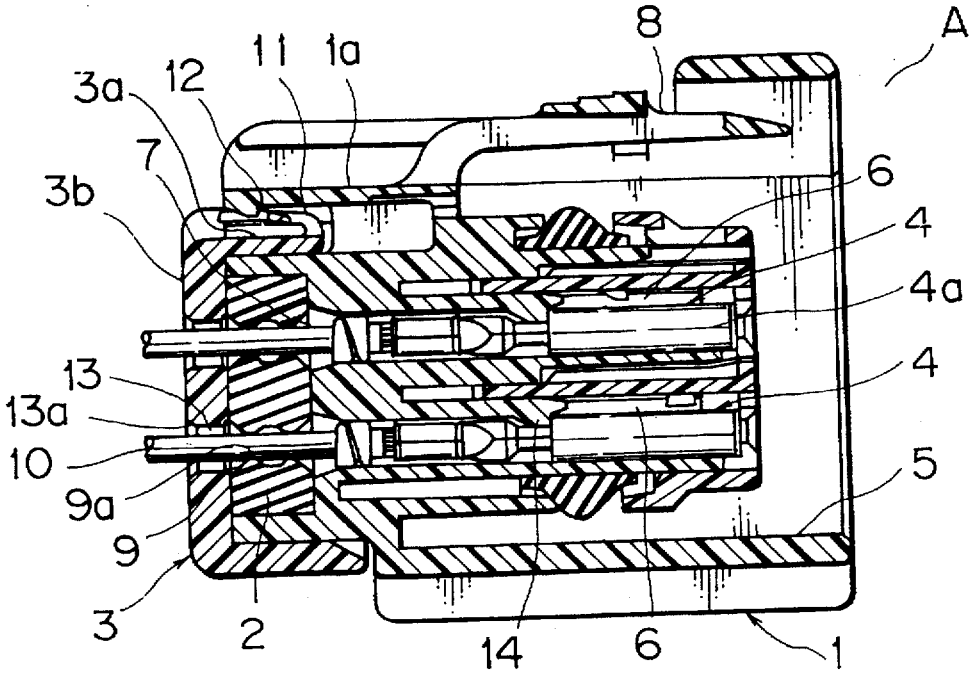
FIG. 1 is a longitudinal sectional view showing a waterproofing connector as one embodiment of the present invention.

FIG. 1 shows a longitudinal sectional view of a waterproofing connector A of the present invention.

The waterproofing connector A is composed of a connector housing 1, a monolithic rubber plug 2 (which can be referred to as a mat sealing) as a sealing member, a sealing cover 3 to be applied to the connector housing 1, and a terminal 4 to be inserted to, and accommodated in, the connector housing 1.

The connector housing 1 is formed by molding a synthetic resin material, and has a coupling section 5 for receiving an opposing connector, being also provided inside with a plurality of terminal accommodating chambers 6. Each terminal accommodating chamber 6 receives and accommodates therein a terminal 4 having a small-diameter cylindrical electrical contacting section 4*a*. In the rear section of the terminal accommodating chambers, a recess 7 is formed for receiving a rubber plug 2, and the external surface 1*a* of the connector housing 1 is formed with a locking arm 8 for securing an engagement thereof with the opposing connector.

The rubber plug 2 is formed in such a manner that it covers the entire terminal accommodating chambers 6 of the connector housing 1, and also has a plurality of terminal insertion holes 9 respectively corresponding to one of the terminal accommodating chambers 6, wherein each terminal insertion hole 9 is formed with an annular projection 9*a* on the inner surface thereof, the diameter of the terminal insertion hole 9, which is formed at the far end of the annular projection 9*a*, being made slightly thinner than the external diameter of the lead 10 connected with the terminal 4.

The sealing cover 3 is made by molding a synthetic resin material, and is formed as a lid for covering the rear portion of the connector housing 1, wherein the peripheral wall 3*a* of the sealing cover 3 is formed with a resilient locking arm 11, so that the sealing over 3 is secured to the connector housing 1 by engaging the arm 11 thereof with a locking claw 12 which is provided inside the external wall 1*a* of the connector housing 1.

Figure 2:
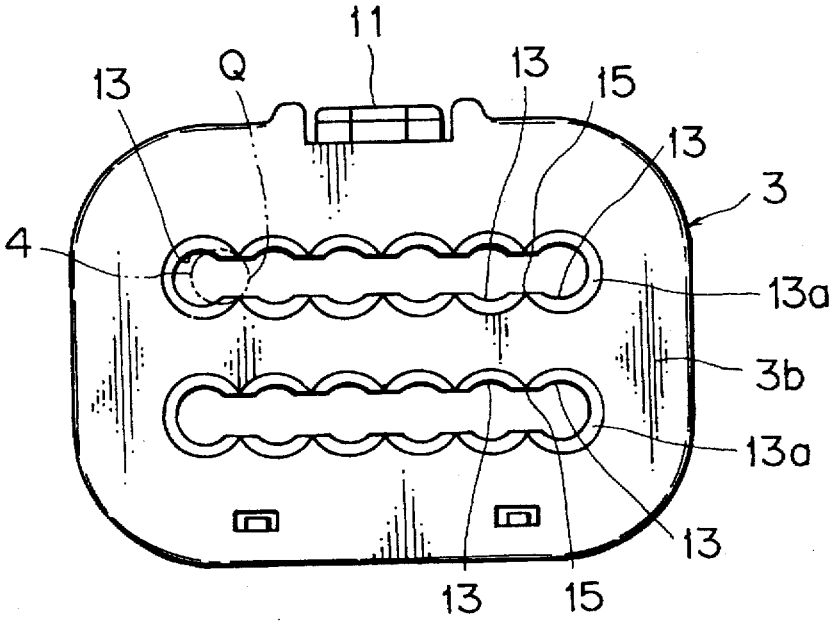
FIG. 2 is a front view of a sealing cover of FIG. 1.
Figure 3:
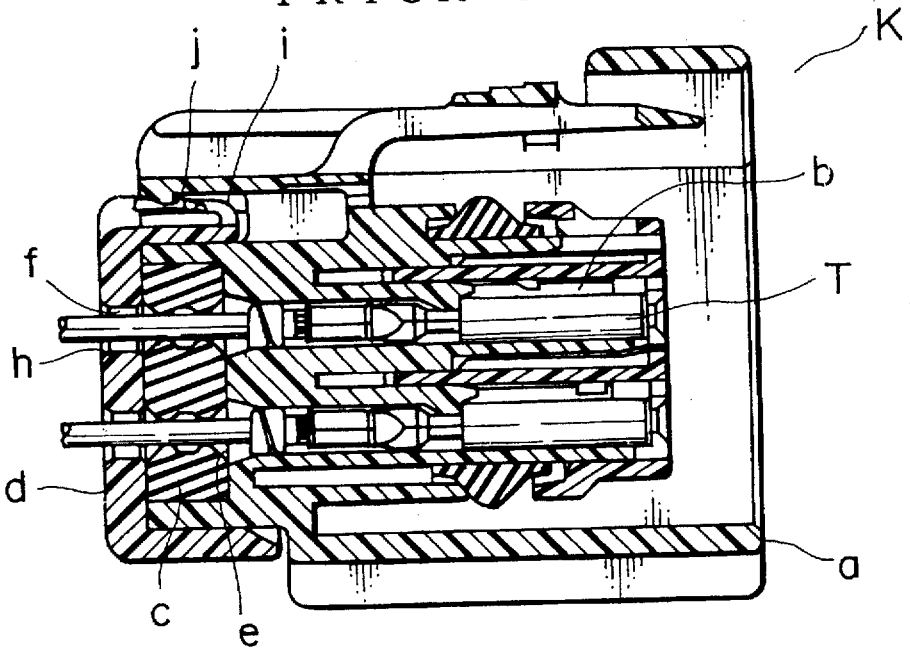
FIG. 3 PRIOR ART
FIG. 3 is a longitudinal sectional view of a conventional waterproofing connector.
Figure 4:
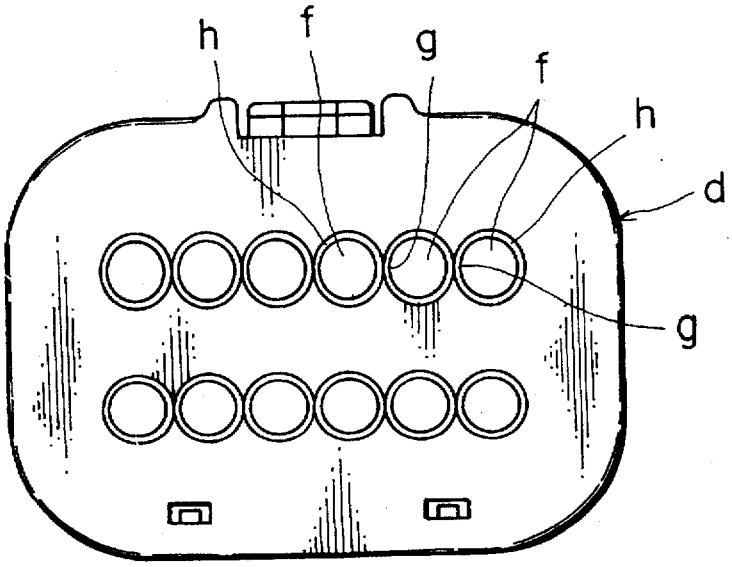
FIG. 4 PRIOR ART
FIG. 4 is a front view of the sealing cover of FIG. 3.
Figure 5:
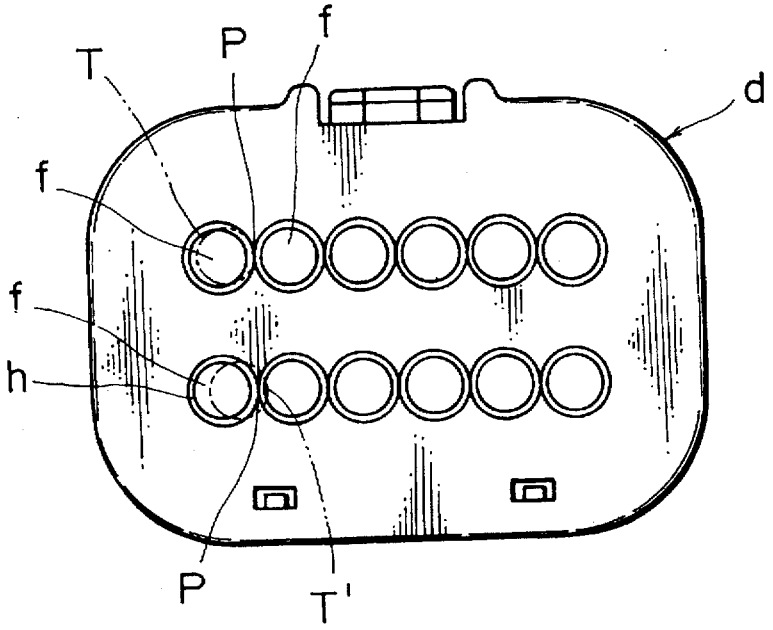
FIG. 5 PRIOR ART
FIG. 5 is an explanatory view showing a biased position of the terminal to be inserted into the through hole of the sealing cover of FIG. 4.

A shown in FIG. 2, the external wall 3*b* of the sealing cover 3 is formed with a plurality of through holes 13, just like the through holes f formed in a conventional waterproofing connector shown in FIG. 4, each aligning with the respective terminal insertion holes 9 of the rubber plug 2, wherein each of the through holes 13 is connected with an adjacent hole 13 by an interconnection 15 being formed by a notch in a partition wall between adjacent through holes 13 and having a width narrower than the diameter of the through holes 13.

On the peripheral surface of each of the through holes 13, a tapered section 13*a* is formed and open to the external surface 3*b* of the sealing cover 3.

For assembly the waterproofing connector A, the rubber plug 2 is first fit into the rubber plug accommodating recess 7 of the connector housing 1 and after, putting the sealing cover 3 thereon, the resilient locking arm 11 of the sealing cover 3 is made to engage with the locking claw 12 of the connector housing 1 to secure the cover 3 to the connector housing 1.

Then, the electrical contacting section 4*a* of the terminal 4 is inserted and pushed into the through hole 13 of the sealing cover 3, whereby the terminal 4 is inserted into the terminal accommodating chamber 6, and locked by a lance 14 formed therein.

When inserting the electrical contacting section 4*a* of the terminal 4 into the through hole 13, as the connecting groove 15 is formed between interconnection, and interconnects, the two adjacent holes 13, even in the case that the position of the terminal 4 for its insertion is biased toward a position Q (P in the conventional case) where the tapered section 13*a* is open to the external wall 3*b* of the sealing cover 3, the terminal 4 is still properly guided along the tapered section 13*a* into the through hole 13, and securely inserted therein.

Thus, a terminal inserting operation in the waterproofing connector A is greatly facilitated, and thereby the productivity in the terminal inserting process is greatly improved.

Since the waterproofing connector of the present invention is constructed in such a manner that the adjacent through holes formed in the sealing cover are mutually connected by notching the partition wall therebetween, a bias-limiting position of the terminal to be inserted therein is capable of being enlarged as compared with the holes formed only with a tapered surface, and the positioning of the terminal to be inserted is thereby facilitated, improving subsequently the productivity in the terminal inserting process.

Thus, there are such advantages that not only it is suitable for a small-size connector containing small-diametered terminals and for a multi-terminal connector having many terminals therein, but it provides a great adaptability for an automatic terminal inserting machine as well.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A waterproofing connector including a connector housing having a plurality of terminal accommodating chambers, a sealing member mounted in said connector housing extending across ends of said terminal accommodating chambers to seal terminals installed in said terminal accommodating chambers, and a sealing cover applied to said connector housing and containing a plurality of aligned through holes separated by partition walls having interconnections between said through holes so that adjacent holes communicate with one another, said interconnections being formed by notches in said partition walls and having a width narrower than the diameter of said through holes.

2. A waterproofing connector as claimed in claim 1, wherein said through holes are respectively provided with a tapered surface for guiding a terminal through said sealing cover.

3. A waterproofing connector as claimed in claim 1, wherein said sealing member contains terminal insertion holes, each being formed with an annular projection on an inner surface thereof, the diameter of said annular projection being smaller than an external diameter of a lead wire connected to terminals installed in said terminal accommodating chambers.

* * * * *